US005562486A

United States Patent [19]

Saijo et al.

[11] Patent Number: 5,562,486

[45] Date of Patent: Oct. 8, 1996

[54] LOCK DETECTION CONNECTOR

[75] Inventors: Eiji Saijo; Hajime Okada; Masashi Saito; Takeshi Tsuji, all of Yokkaichi, Japan

[73] Assignee: Sumitomo Wiring Systems, Ltd., Mie, Japan

[21] Appl. No.: 330,738

[22] Filed: Oct. 28, 1994

Related U.S. Application Data

[63] Continuation-in-part of Ser. No. 221,244, Mar. 31, 1994, Pat. No. 5,464,353.

[30] Foreign Application Priority Data

| | | | |
|---|---|---|---|
| Apr. 21, 1993 | [JP] | Japan | 5-119171 |
| Dec. 6, 1993 | [JP] | Japan | 5-340033 |
| Dec. 16, 1993 | [JP] | Japan | 5-344331 |
| Dec. 27, 1993 | [JP] | Japan | 5-074599 U |

[51] Int. Cl.[6] ..... H01R 3/00

[52] U.S. Cl. ..... 439/489; 439/188

[58] Field of Search ..... 439/188, 488, 439/489, 490, 350, 357, 372; 200/51.09, 51.1

[56] References Cited

U.S. PATENT DOCUMENTS

| | | | |
|---|---|---|---|
| 3,611,261 | 10/1971 | Gregory . | |
| 4,316,647 | 2/1982 | Bailey et al. . | |
| 4,904,196 | 2/1990 | Sueyoshi et al. . | |
| 4,917,627 | 4/1990 | Hendricks . | |
| 5,061,204 | 10/1991 | Murakami . | |
| 5,131,865 | 7/1992 | Taguchi et al. . | |
| 5,158,473 | 10/1992 | Takahashi et al. . | |
| 5,234,357 | 8/1993 | Yamaguchi . | |
| 5,277,608 | 1/1994 | Oda | 439/489 X |

FOREIGN PATENT DOCUMENTS

| | | |
|---|---|---|
| 0440330 | 8/1991 | European Pat. Off. . |
| 2-50982 | 4/1990 | Japan . |
| 3-272578 | 12/1991 | Japan . |

*Primary Examiner*—Khiem Nguyen
*Attorney, Agent, or Firm*—Oliff & Berridge

[57] ABSTRACT

Lock detecting terminals are disposed on one of connector housings that are engageable with each other, and a short circuit terminal is disposed on the other connector housing, the short circuit terminal serving to short-circuit the lock detecting terminals upon engagement of both housings. The lock detecting terminals are arranged so as to extend along an inner wall surface of the housing in such a manner that the distal ends thereof are not contact with the edge portion of the engagement opening of the housing. As a result of this construction, the lock detecting terminals will no longer be deformed while caught by the edge portion of the housing even when the housing is being engaged with the housing misaligned. Furthermore, the one connector has the short circuit electrode exposed to the outside and has a cover movable between a protecting position and an opening position, the protecting position being such a position as to allow the cover to cover the short circuit electrode, the opening position being such a position as to allow the cover to expose the short circuit electrode.

7 Claims, 13 Drawing Sheets

LOCK DETECTION CONNECTOR

This is a continuation-in-part of application Ser. No. 08/221,244, filed Mar. 31, 1994, now U.S. Pat. No. 5,464, 352.

BACKGROUND OF THE INVENTION

The present invention relates to a lock detecting connector which can detect that a pair of connectors engageable with each other are in a complete locked state.

Recently, automobiles carry air bags. Safety devices such as these air bags must be highly reliable, which thus demands that incomplete connection of male and female connectors be avoided with certainty. To meet such demand, connectors whose complete connection is detected electrically have been developed to date.

FIG. 1 shows a conventionally known lock detecting structure of this type. A groove-like engagement portion 1*a* is formed on the upper surface of a connector 1 on the male side that is firmly fixed on a board 2. On the other hand, a flexible lock piece having a projection 7*a* is integrally formed on the upper surface of a connector 5 on the female side to be engaged with the connector 1 on the male side, the projection 7*a* being held by the engagement portion 1*a* when both connectors 1, 5 are connected.

In addition, within the connector 1 on the male side, a pair of lock detecting electrodes 4*a*, 4*b* are disposed while positioned on both sides of an inverted T-shaped position determining piece 3 as shown in FIG. 2. On the other hand, within the connector 5 on the female side, a U-shaped short circuit electrode 6 is arranged so as to interpose the position determining piece 3 between the leg portions thereof as shown in FIG. 2.

In the thus designed lock detecting structure, as the connector 5 on the female side is being inserted into the connector 1 on the male side while elastically deforming a flexible lock piece 7 thereof, the short circuit electrode 6 is elastically deformed upward by a guide projection 3*b* formed on a partition wall 3*a* of the position determining piece 3 as shown in FIG. 3, so that the short circuit electrode 6 keeps distance from the detecting electrodes 4*a*, 4*b* at the initial stage of the insertion. Then, when the connector 5 on the female side has been inserted into a regular position of the connector 1 on the male side, the projection 7*a* of the flexible lock piece 7 is held by the engagement portion 1*a* to thereby unremovably lock both connectors 1, 5. At the same time, the short circuit electrode 6 comes out of the projection 3*b* to come in contact with the lock detecting electrodes 4*a*, 4*b* as shown in FIG. 4. The lock detecting electrodes 4*a*, 4*b* are connected to a not shown detecting circuit, so that it is judged that both connectors 1, 5 have been connected in the locked state by way of short-circuiting the lock detecting electrodes 4*a*, 4*b*.

In the aforementioned conventional lock detecting structure, the short circuit electrode 6 is disposed within the connector 5 on the female side. This structure is advantageous in preventing the detecting electrodes 4*a*, 4*b* from being short-circuited while insulated by foreign matter such as dirt and dust upon contact between the detecting electrodes 4*a*, 4*b* and the short circuit electrode 6, since foreign matter is hard to deposit on the short circuit electrode 6. However, this structure does not allow the user to check the condition of the short circuit electrode 6 visibly; i.e., the short circuit electrode 6 is left concealed, and this is undesirable in terms of quality control.

To overcome this problem, the short circuit electrode may be disposed on the outer surface of the connector, and a cover may be provided to cover the entire part of the connector having the short circuit electrode as long as the connector having the short circuit electrode is not connected to the mating connector. And the cover may be removed to expose the short circuit electrode when the short circuit electrode must be inspected visibly or when the connector having the short circuit electrode is connected to the mating connector. However, this design is still disadvantageous in involving an extra step of removing the cover prior to connecting both connectors, which leads to a reduction in the efficiency of the entire connecting operation.

An example of the connector using the above lock detection structure is shown in FIGS. 5 and 6.

FIG. 5 shows a connector housing 40 on the male side. A plurality of male terminals 41 are accommodated within the housing 40, and these terminals 41 project outward through the wall surface in the back of the housing 40. In addition, from the wall surface in the back projects a rib 42, which extends in parallel with the terminals 41 within the housing 40. A partition wall 43 standing upright in the middle of the rib 42 divides the upper surface of the rib 42 into right and left parts. Lock detecting terminals 44 are disposed on such right and left parts of the rib 42. Both lock detecting terminals 44 project outward through the wall surface in the back of the housing 40 like other terminals. On the other hand, a connector housing 45 on the female side accommodates a not particularly shown short circuit terminal. The short circuit terminal has such a shape as to come in contact with the lock detecting terminals 44 simultaneously upon engagement (complete engagement) of the connector housings 40, 45. Therefore, when both connector housings 40, 45 have been engaged with each other completely, both lock detecting terminals 44 are ready to conduct through the short circuit terminal. As a result, the complete engagement can be detected electrically.

However, the aforementioned structure in which the lock detecting terminals are disposed in the middle of the connector housing 40 addresses a problem shown in FIG. 7. The problem is that the edge portion of the connector housing 45 on the female side is caught on the distal end of the rib 43 or on the distal ends of the lock detecting terminals 44 when both housings 40, 45 are being engaged misaligned. This causes the rib and the like to be deformed, which may in turn make engagement of the connector housings or lock detection of the connector housings impossible depending on the degree of deformation.

SUMMARY OF THE INVENTION

The present invention has been made in consideration of the aforementioned circumstances and its object resides in providing a connector whose lock detecting terminals are not deformed even when the connectors are being engaged with each other misaligned.

Another object resides in providing a lock detecting structure for connectors which facilitates quality control and prevents reduction in the efficiency of the operation of connecting the connectors.

To accomplish the above object, the present invention is applied to a lock detecting connector, which includes at least a pair of lock detecting terminals in one of connector housings and a short circuit terminal in the other connector housing, the short circuit terminal serving to detect a locked state of both connector housings by way of short-circuiting the pair of lock detecting terminals with both connector housings engaged with each other completely, wherein the lock detecting connector is characterized in that the lock detecting terminals are arranged along an inner wall surface of the one connector housing accommodating the lock detecting terminals, and that distal ends of the lock detecting terminals are positioned backward with respect to an engagement opening of the one connector housing.

Furthermore, to accomplish the above object, the present invention is applied to a connector, which includes at least a pair of lock detecting terminals in one of connector housings and a contact terminal in the other connector housing, the contact terminal serving to detect a locked state of both connector housings by way of short-circuiting the pair of lock detecting terminals with both connector housings engaged with each other completely, wherein the connector is characterized in that the lock detecting terminals are arranged along an inner wall surface of the one connector housing accommodating the lock detecting terminals, and that protective walls for covering the lock detecting terminals are formed on an inner surface of the one connector housing excluding a portion of the inner surface coming in contact with the short circuit terminal.

According to the aforementioned construction, even when one connector housing is misaligned with the mating connector housing at the time of engaging both connector housings, it is prevented that the edge portion of the housing on the short circuit side will come in contact with the lock detecting terminals.

The advantageous effects of the present invention are as follows. Since the lock detecting terminals are disposed along the inner wall surface of the connector housing accommodating the lock detecting terminals as well as backward with respect to the engagement opening thereof, the case where the lock detecting terminals are deformed by forcible engagement can be obviated even if both connector housings are being engaged misaligned.

Furthermore, to accomplish the above object, the present invention is applied to a lock detecting structure for connectors wherein a short circuit electrode is disposed on one of a pair of connectors being connected so as to be unremovable by engagement of a flexible lock piece with an engagement portion, and detecting electrodes are disposed on the other connector, the detecting electrodes coming in contact with the short circuit electrode when both connectors have been locked, so that locking of both connectors can be detected by contact between the short circuit electrode and the detecting electrodes, wherein the lock detecting structure is characterized in that the one connector has the short circuit electrode exposed to the outside and has a cover movable between a protecting position and an opening position, the protecting position being such a position as to allow the cover to cover the short circuit electrode, and the opening position being such a position as to allow the cover to expose the short circuit electrode, and that the cover is moved from the protecting position to the opening position by the other connector as both connectors are being connected.

With both connectors not connected to each other, the cover disposed on one of the connectors is set to the protecting position at which the short circuit electrode is covered. Foreign matter such as dirt and dust is hard to deposit on the short circuit electrode under this condition. When the cover is moved from the protecting position to the opening position, whether foreign matter is deposited on the short circuit electrode can be visibly checked.

In addition, the operation of connecting both connectors is carried out when the cover on the one connector is set to the protecting position. As both connectors are being connected to each other, the cover is moved from the protecting position to the opening position while pushed by the other connector, so that the short circuit electrode is ready to come in contact with the detecting electrodes. When both connectors have been correctly connected and locked so as not to be removable, the detecting electrodes come in contact with the uncovered short circuit electrode, which allows the locked state of both connectors to be detected.

As described in the mode of operation, the present device is characterized as allowing the user to visibly check the condition of the short circuit electrode, which facilitates quality control. The present device is also characterized as dispensing with the extra step of removing the cover prior to the operation of connecting both connectors, which contributes to improved efficiency in the connecting operation.

DETAILED DESCRIPTION OF THE PREFERRED EMBODIMENTS

An embodiment of the present invention will now be described hereinafter with reference to the drawings.

FIRST EMBODIMENT

Figure 1:
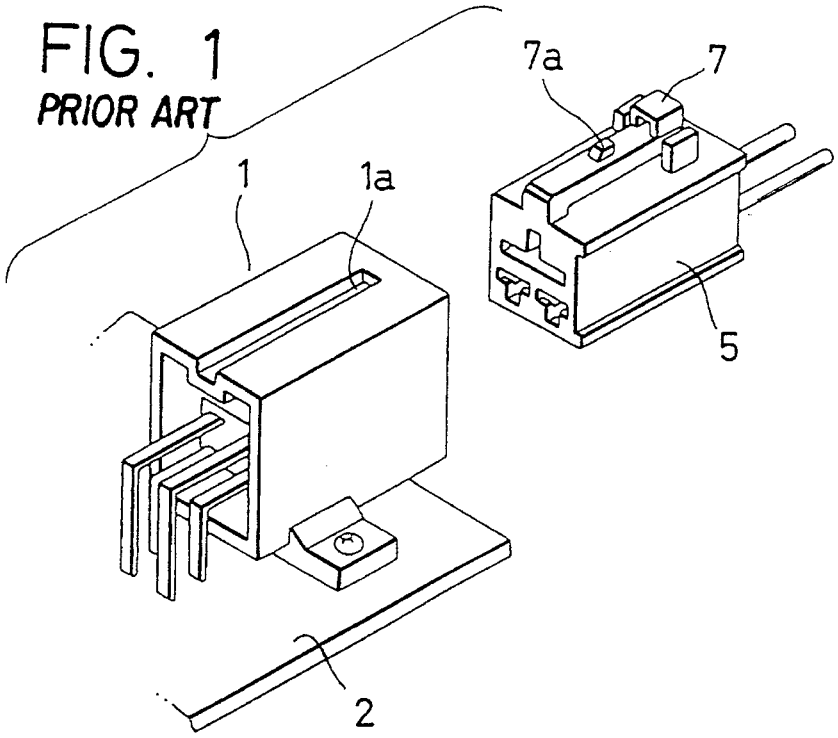
FIG. 1 PRIOR ART
FIG. 1 is a perspective view of the appearance of a conventional lock detecting structure.
Figure 2:
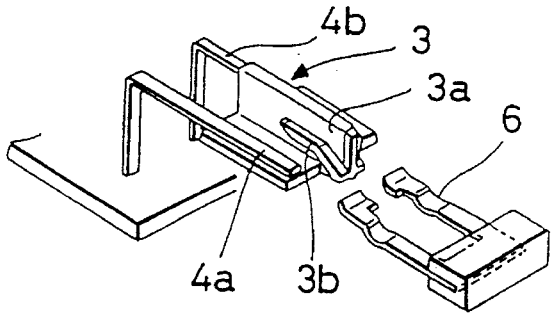
FIG. 2 PRIOR ART
FIG. 2 is a perspective view of a short circuit electrode and lock detecting electrodes.
Figure 3:
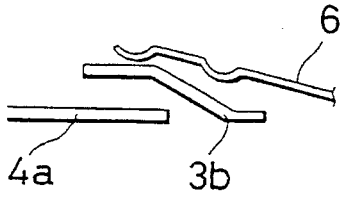
FIG. 3 PRIOR ART
FIG. 3 is a side view showing connection between the short circuit electrode and the lock detecting electrodes.
Figure 4:
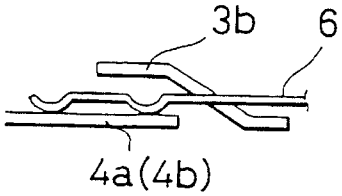
FIG. 4 PRIOR ART
FIG. 4 is a side view showing connection between the short circuit electrode and the lock detecting electrodes.
Figure 5:
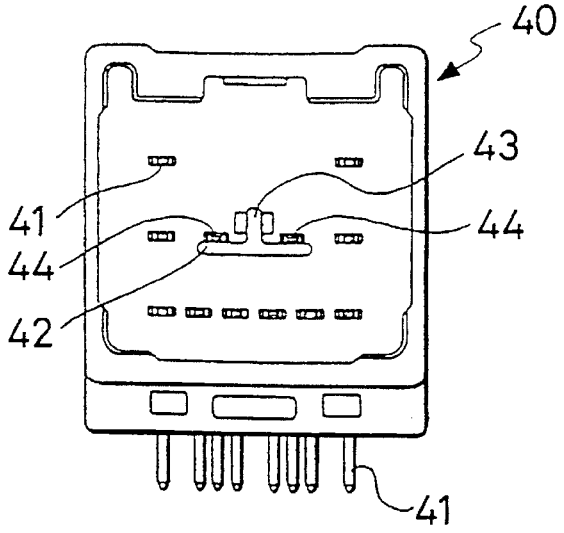
FIG. 5 PRIOR ART
FIG. 5 is a front view of a conventional housing on the male side.
Figure 6:
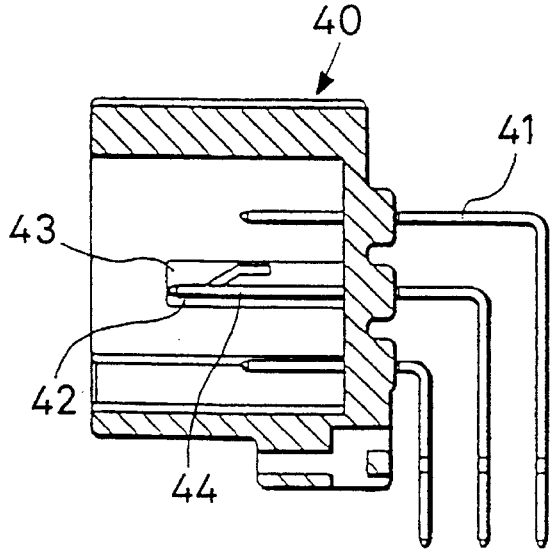
FIG. 6 PRIOR ART
FIG. 6 is a side sectional view of FIG. 5.
Figure 7:
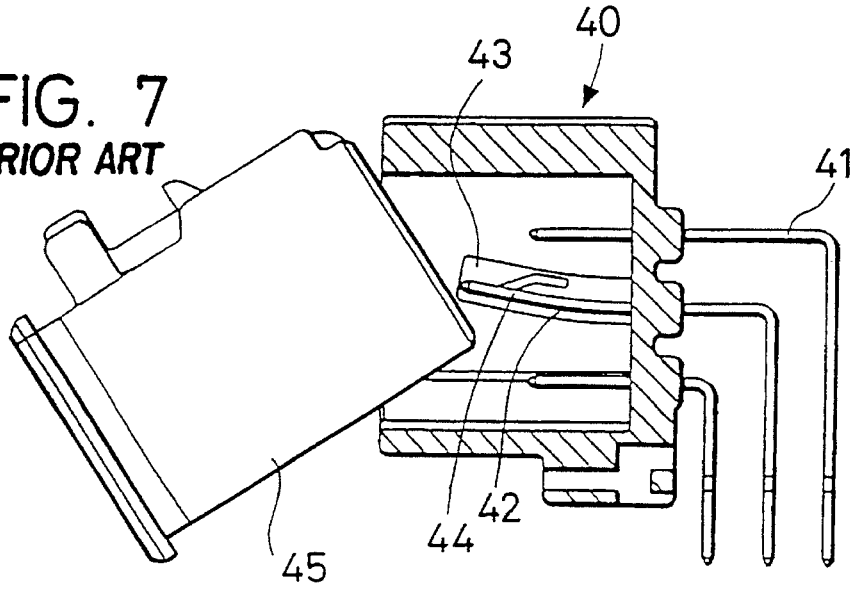
FIG. 7 PRIOR ART
FIG. 7 is a sectional view showing a conventional problem.
Figure 8:
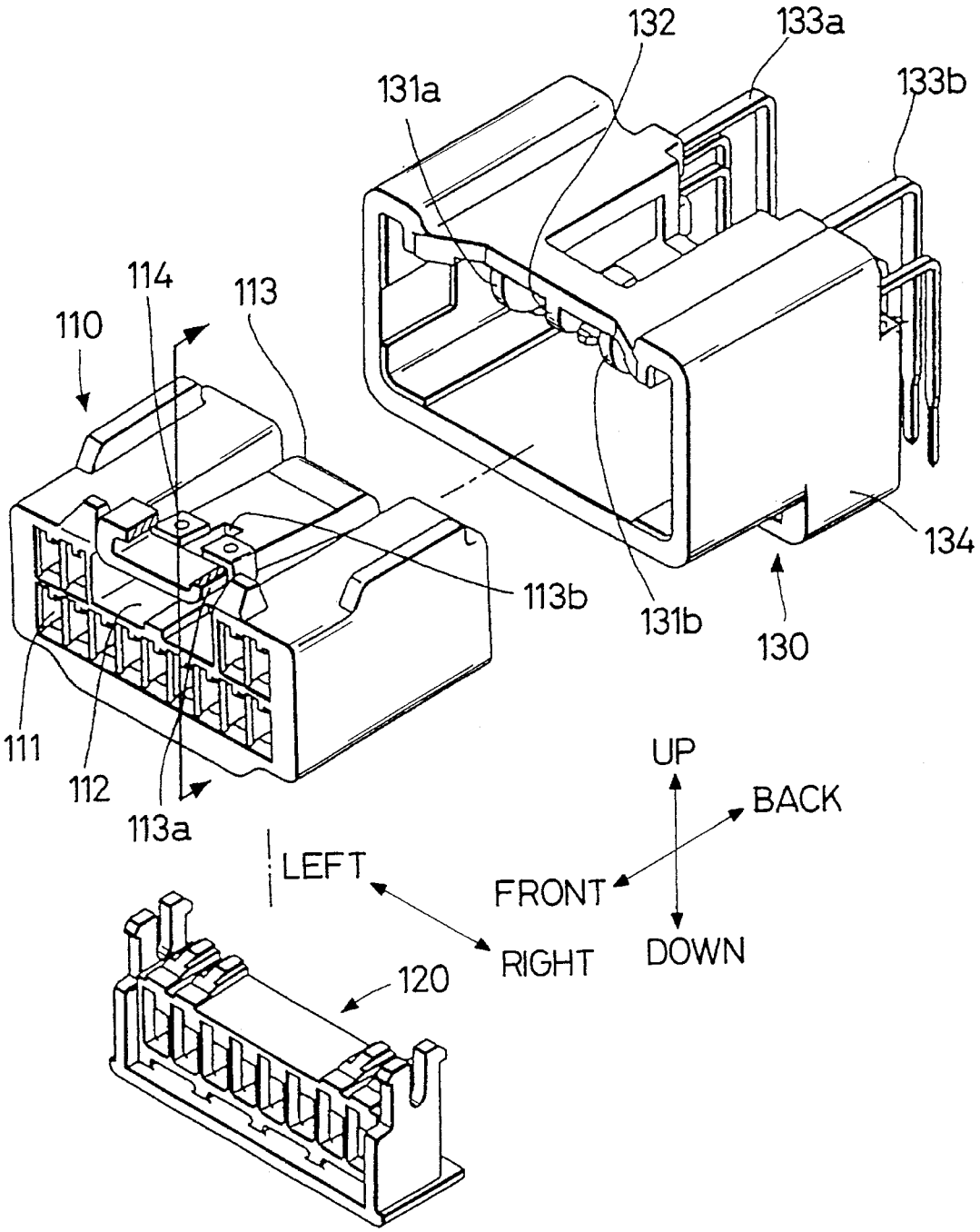
FIG. 8 is a perspective view of a lock connector, which is a first embodiment of the present invention.

FIG. 8 is a perspective view of a lock connector, which is a first embodiment of the present invention.

Referring to the drawing, a connector housing 110 on the male side includes a plurality of small chambers 111 each formed therethrough in the axial direction of cables, and each of the small chambers 111 serves to hold a terminal on the female side inserted therein to not only in the provisionally engaged state but also in the normally engaged state with the aid of a retainer 120. In addition, an axially extending groove-like recess 112 is formed at the intermediate part of the upper surface of the connector housing 110 on the female side, and a flexible lock piece 113 is formed in the recess 112 while extending from the rear side toward the front side in the slantwise upward direction. A pinching portion 113*a* is formed at the foremost end part of the flexible lock piece 113, and moreover, an axially extending elongated engagement hole 113*b* is formed through the flexible lock piece 113 at the position located slightly behind the pinching portion 113*a*.

Figure 9:
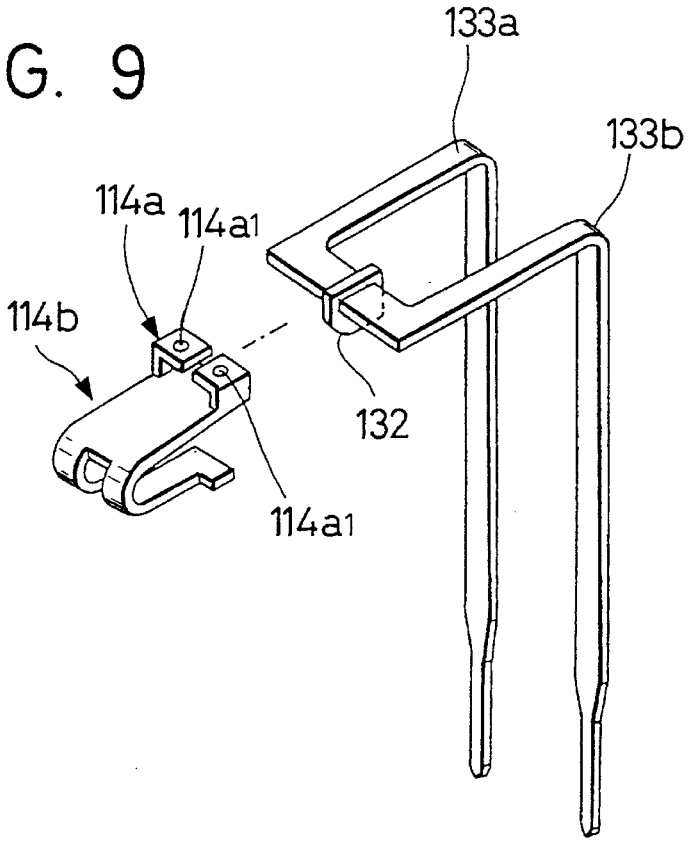
FIG. 9 is a perspective view of a short circuit terminal and lock detecting terminals.

The flexible lock piece 113 is provided with a short circuit terminal 114 as shown in FIG. 9. The short circuit terminal 114 is composed of electrode portions 114*a* for holding a part of the flexible lock piece 113 between the engagement hole 113*b* and the pinching portion 113*a* so as to clamp such part of the flexible lock piece 113 and a spring portion 114*b* having a U-shaped sectional contour and integrated with the electrode portions 114*a*, and the lowermost end of the spring portion 114*b* comes in contact with the bottom surface of the recess 112. It should be noted that a pair of contact protuberances $114a_1$ are formed on the upper surface of the electrode portions 114*a*.

On the other hand, a connector housing 130 on the male side is designed in the hood-shaped configuration in such a manner as to enable the connector housing 110 on the female side to be inserted into the housing 130 on the male side, and a plurality of terminals on the male side each adapted to be electrically connected to a terminal on the female side are supported in the connector housing 130 on the male side at the positions located opposite to the small chambers 111 in the connector housing 110 on the female side. In addition, a pair of axially extending position determining ribs 131*a* and 131*b* adapted to come in contact with the opposite side surfaces of the recess 112 for the purpose of position determination are formed on a ceiling surface of the connector housing 130 on the male side. Additionally, an engagement rib 132 adapted to be brought in engagement with the engagement hole 113*b* when the connector housing 110 on the female side 110 is inserted into the connector housing 130 on the male side to reach a normal position is formed on the ceiling surface of the connector housing 130 on the male side at the intermediate position between both the position determining ribs 131*a* and 131*b*. A pair of lock detecting terminals 133*a* and 133*b* as shown in FIG. 9 are disposed on a ceiling surface 130*a* with the rib 132 located at the intermediate position between both the position determination ribs 131*a* and 131*b*. The pair of lock detecting terminals 133*a* and 133*b* are disposed so as to extend along such ceiling surface 130*a* in intimate contact therewith, and the contact surfaces of the lock detecting terminals are kept open to the outside while facing downward. In addition, while the position of the distal ends of both lock detecting terminals 133*a*, 133*b* is substantially aligned with the opening edge of the connector housing 130 on the male side in this embodiment, an opening edge portion at which both lock detecting terminals 133*a*, 133*b* are disposed is recessed backward with respect to the remaining opening edge portion. Therefore, it can be said that the distal ends of both lock detecting terminals 133*a*, 133*b* are positioned backward with respect to the engagement opening, taking into account the fact that the actual engagement opening with the connector housing 110 on the female side is formed by a surface including the remaining opening edge portion of the connector housing 130 on the male side. In other words, the distal ends of both lock detecting terminals 133*a*, 133*b* are set to such a position as not to come in contact with the front edge of the connector housing 110 on the female side even if an attempt is made to engage the connector housing 110 on the female side obliquely with the connector housing 130 on the male side.

The connector housing 130 on the male side includes a fixing portion 134 on the lower surface thereof which is fixedly secured to a not shown printed circuit base board, and the terminals on the male side held in the connector housing 130 on the male side and the lock detecting terminals 133*a* and 133*b* are electrically connected to the printed circuit base board.

Next, a mode of operation of the lock connector constructed in the aforementioned manner will be described below.

With respect to the connector housing 110 on the female side, a plurality of terminals on the female side each having a cable connected thereto by crimping are firmly held in the chambers 111 with the aid of the retainer 120, and the short-circuit electrode 114 is disposed on the flexible lock piece 113. At this time, the upper surface of the spring portion 114*b* of the short circuit terminal 114 comes in contact with the lower surface of the flexible lock piece 113, while the lower surface of the same comes in contact with the upper surface of the recess 112, causing the flexible lock piece 113 to be normally biased in the upward direction. On the other hand, the connector housing 130 on the male side is fixedly mounted on the printed circuit base board via the fixing portion 134.

Figure 10:
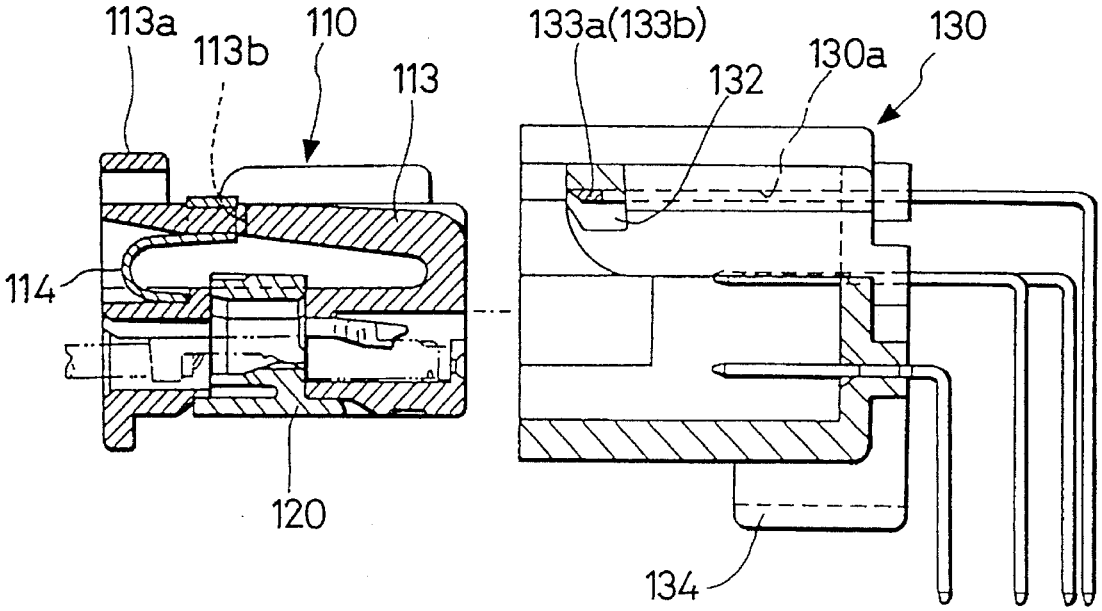
FIG. 10 is a sectional view of the lock connector for showing a procedure for an electrical connection.

As shown in FIG. 10, the connector housing 110 on the female housing is located opposite to the connector housing 130 on the male side, and subsequently, the former is inserted into the latter in such a manner that the position determining ribs 131*a* and 131*b* on the latter are received in the recess 112 of the former.

Figure 11:
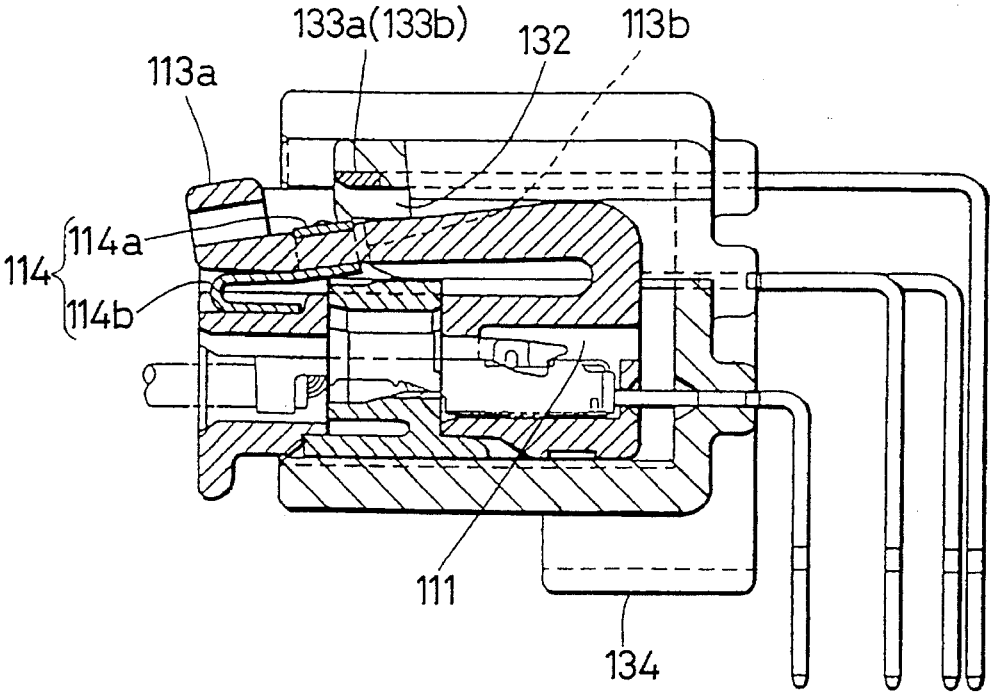
FIG. 11 is a sectional view of the lock connector for showing a procedure for electrical connection.
Figure 12:
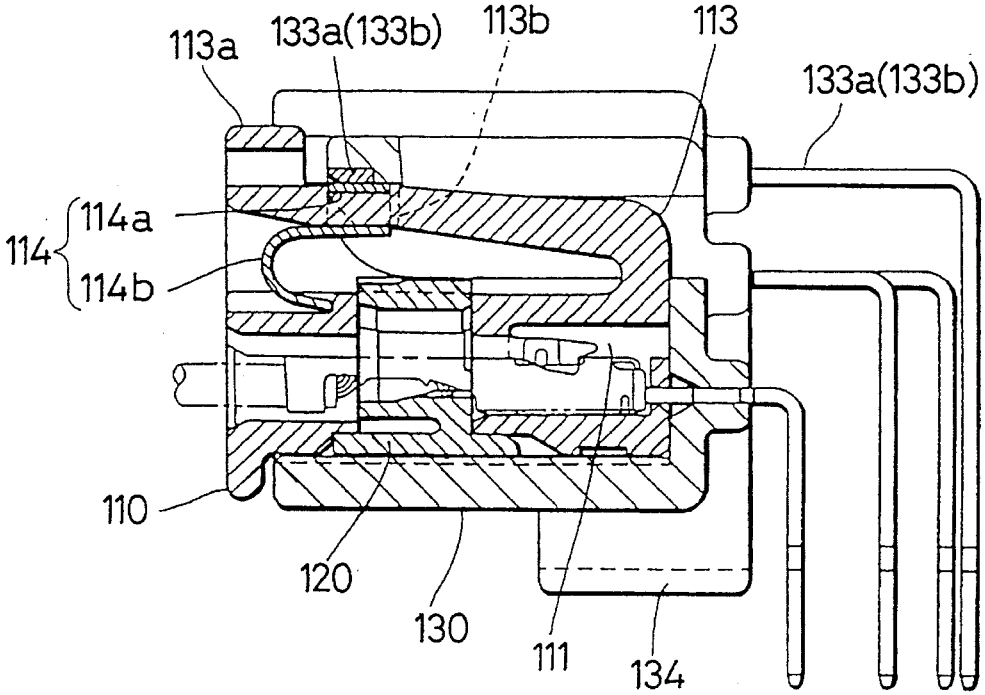
FIG. 12 is a sectional view of the lock connector for showing a procedure for electrical connection.

Since the engagement rib 132 is increasingly brought in contact with the upper surface of the flexible lock piece 113 as the connector housing 110 on the female side is inserted into the connector housing 130 on the male side as shown in FIG. 11, the flexible lock piece 113 is curvedly bent in the downward direction. At this time, the electrode portions 114*a* of the short circuit terminal 114 are displaced in the downward direction, but they are not brought in contact with both the terminals 133*a* and 133*b* even when they reach the position where the lock detecting terminals 133*a* and 133*b* are superimposed on the electrode portions 114*a*.

However, when the connector housing 110 on the female side is inserted into the connector housing 130 on the male side to reach a normal position, the engagement rib 132 faces the engagement hole 113*b*, and thereafter, it is received in the latter, causing the flexible lock piece 113 to be upwardly pushed back by the action of resiliency of the flexible lock piece 113 itself as well as by the action of resiliency of the spring portion 114*b* of the short circuit terminal 114. In such manner, the connector housing 110 on the female side is engaged with the connector housing 130 on the female side in cooperation of the engagement rib 132 with the engagement hole 113*b*.

On the other hand, the electrode portions 114*a* of the short circuit terminal 114 are formed in such a manner that a part of the flexible lock piece 113 is seized by the electrode portion 114*a* of the short circuit terminal 114 in the clamped state. In addition, since the lock detecting terminals 133*a* and 133*b* are arranged on the opposite sides of the engagement rib 132, when the flexible lock piece 113 is upwardly pushed back in that way, the electrode portions 114*a* of the short circuit terminal 114 is electrically connected to both the lock detecting terminals 133*a* and 133*b* by way of short-circuiting. Specifically, the former are short-circuited to the latter in the same timing relationship as that when the connector housing 110 on the female side is engaged with the connector housing 130 on the male side. Since the lock detecting terminals 133*a* and 133*b* are arranged in the connector housing 130 on the female side which is fixedly secured to the printed circuit base board, they are reliably held in the connector housing 130 on the male side regardless of any intensity of vibration imparted thereto, whereby the locked state between both the connector housings 110 and 130 can be detected with excellent reliability.

In such manner, the connector housing 110 on the female side includes the short circuit terminal 114 on the surface onto which the flexible lock piece 113 is biased, and the connector housing 130 on the male side holds the pair of lock detecting terminals 133*a* and 133*b* at the position where the pair of lock detecting terminals 133*a* and 133*b* come in contact with the flexible lock piece 113 when the flexible lock piece 113 is elastically restored after engaged with the connector housing 130 by flexing. Thus, the elastic restoring action of the flexible lock piece 113 and the short-circuiting between two opponent terminals are simultaneously achieved without any deviation from the correct timing relationship established among these components.

By the way, this embodiment is characterized as arranging the lock detecting terminals 133*a*, 133*b* so as to extend along the ceiling surface 130*a* and positioning the distal ends thereof backward with respect to the engagement opening of the housing 130 so that front edge of the connector housing 110 on the female side cannot reach the lock detecting terminals even when the connector housing 110 on the female side is being engaged with the connector housing 130 on the male side misaligned. Therefore, there is no likelihood that the connector housing 110 on the female side will be caught on the lock detecting terminals 133*a*, 133*b*. Hence, the lock detecting terminals 133*a*, 133*b* can be held at a normal position at all times, which not only facilitates connector housing engagement operation but also contributes to reliable lock detection.

It should be noted that the present invention may be modified in various modes. While the lock detecting terminals 133*a* and 133*b* are disposed on the ceiling surface of the housing, these terminals may be disposed, e.g., on a side wall surface of the housing. In addition, while a curvedly bent opening edge of the housing 130 such that an portion thereof at which the lock detecting terminals are disposed is recessed backward has been described, that portion may not necessarily be recessed backward as such, but may be flush with the remaining portion.

SECOND EMBODIMENT

Figure 13:
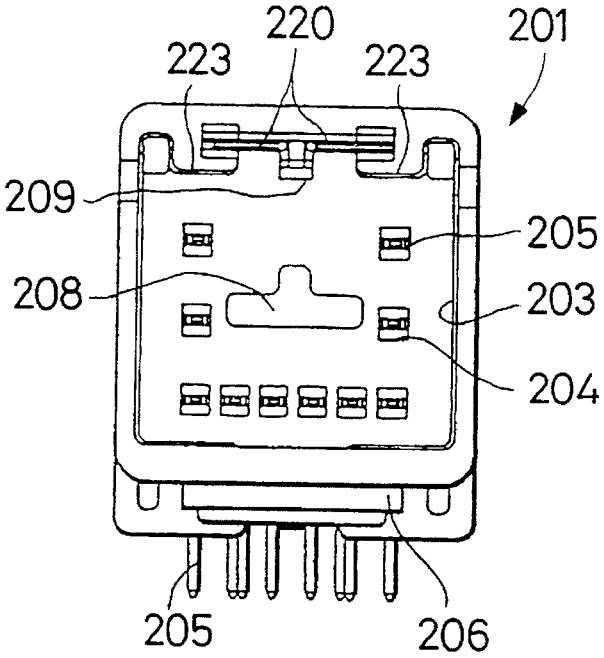
FIG. 13 is a front view of a male housing of the second embodiment.
Figure 14:
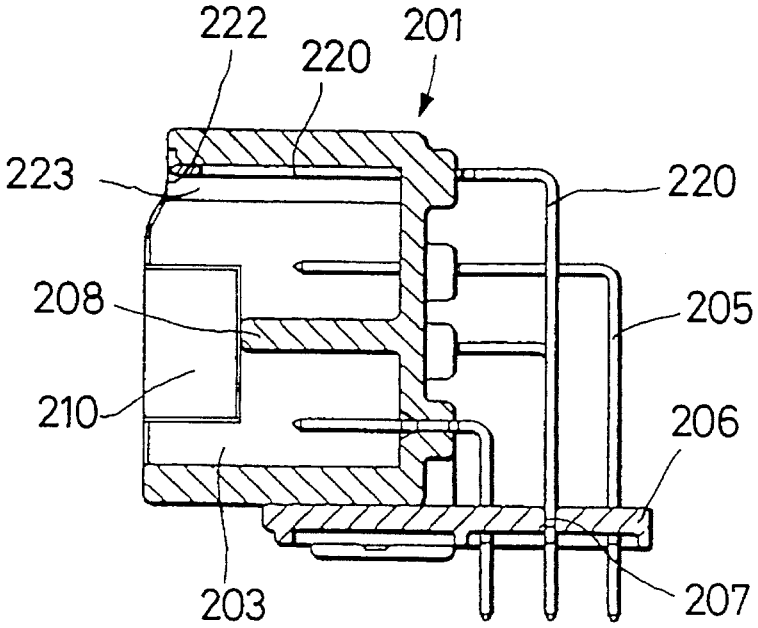
FIG. 14 is a side sectional view of FIG. 13.
Figure 15:
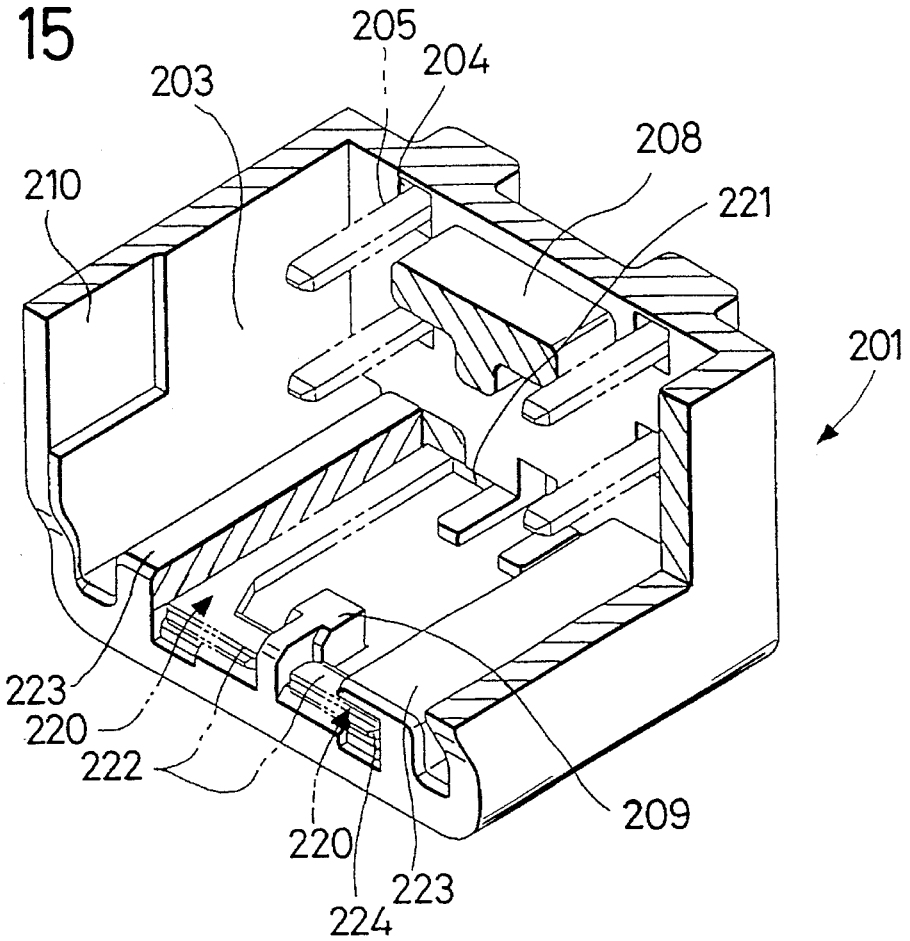
FIG. 15 is a perspective view of the male housing as viewed from below with lock detecting terminals cut away therefrom.

FIGS. 13 to 15 show a connector housing on the male side (hereinafter referred to as "male housing 201") of a connector constructed according to the second embodiment. The male housing is of a square cylinder that is open on one side. Inside the male housing is an engagement chamber 203 that allows a connector housing on the female side (hereinafter referred to as "female housing 202") to be inserted thereinto. In addition, a plurality of insertion holes 204 for inserting male terminals 205 are formed on the rear wall surface of the engagement chamber 203 so as to pass therethrough. Male terminal 205 portions projecting outside the housing 201 are bent downward so as to be substantially perpendicular, and the ends thereof are inserted into corresponding positions on a PCB board (not shown) in this embodiment. Further, to prevent these ends of the terminals from being out of position, a correcting plate 206 is provided in this embodiment. As shown in FIG. 14, the correcting plate 206 projects from the bottom of the male housing 201. The correcting plate 206 has a plurality of small through holes 207 corresponding to the terminals so that the terminals 205 can be held while inserted into such small through holes 207. Furthermore, a guide projection 208 for guiding the female housing 202 engaging operation is projected from the middle part of the rear wall surface in the engagement chamber 203. This guide projection 208 extends horizontally and longer than the terminals in the frontward direction. Still further, a retaining projection 209 for locking the female housing 202 is formed at a position that is in the middle of the upper wall surface of the engagement chamber 203 and closer to the opening edge of the front surface of the engagement chamber 203 (see FIG. 15). The retaining projection 209 will be described later.

It should be noted that reference numeral 210 denotes a recess for reducing frictional resistance at the time of engagement. A pair of recesses 210 are formed on the confronting side wall surfaces of the engagement chamber 203.

Figure 16:
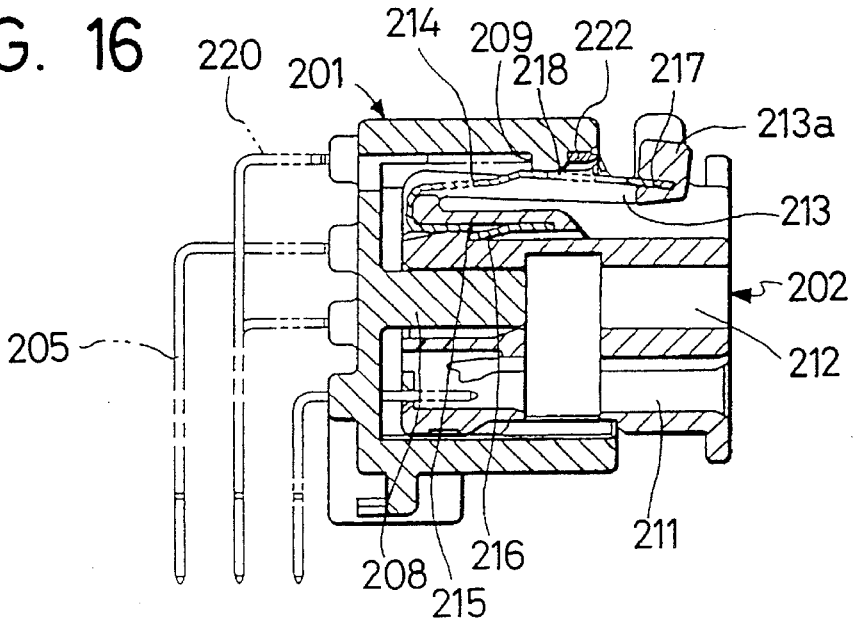
FIG. 16 is a sectional view of the connector housings in the course of being engaged.
Figure 17:
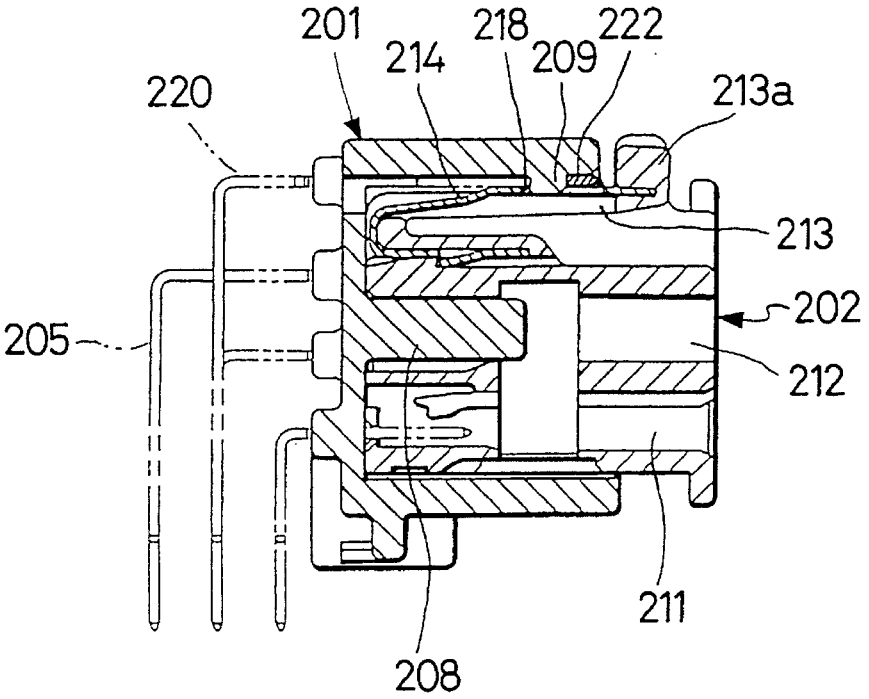
FIG. 17 is a sectional view of the connector housings having been completely engaged.

On the other hand, the female housing 202 that is engageable with the engagement chamber 203 has a plurality of terminal accommodating chambers 211 such as shown in FIGS. 16, 17 so as to correspond to the aforementioned male terminals 205. Female terminals (not shown) connectable to the male terminals 205 are accommodated in the terminal accommodating chambers 211 so as not to come off. In addition, window portions 212 pass through the female housing 202 horizontally so as to be surrounded by the terminal accommodating chambers 211. These window portions 212 receive the aforementioned guide projection 208 when both housings 201, 202 are engaged with each other.

Figure 18:
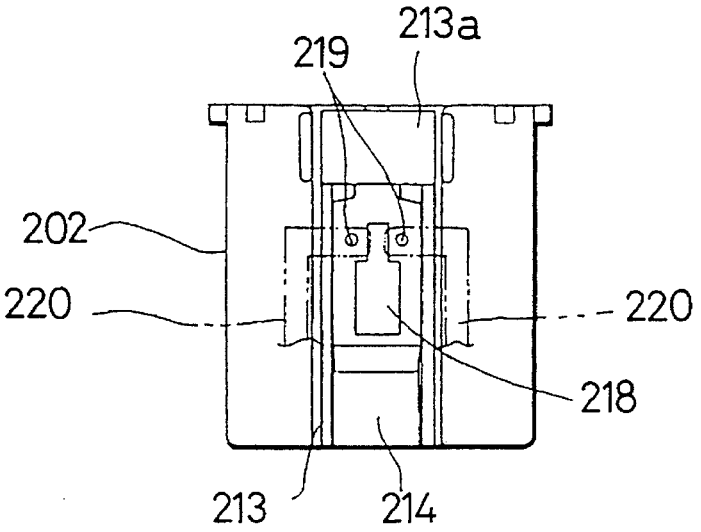
FIG. 18 is a plan view of a female housing.

Furthermore, a resilient operation piece 213 for locking the male housing 201 is disposed in the middle of the upper surface of the female housing 202 (see FIGS. 16 to 18). This resilient operation piece 213 is formed so as to be cantilevered with the edge portion on the engagement surface side of the male housing 201 as a fulcrum, so that the resilient operation piece 213 can be flexed up and down. In addition, an operation portion 213*a* is formed on the free end side of the resilient operation piece 213. A portion between the operation portion 213*a* and the fulcrum is frame-like and has a short circuit terminal 214 made of an electrically conducting material and is formed in the following manner. One end side of the short circuit terminal 214 is inserted into an insertion hole 215 formed horizontally at the fulcrum of the resilient operation piece 213, and is designed so as not to come off while hooked by a pawl 216 formed by cutting a part of the hole 215 out. Still further, the other end side of the short circuit terminal 214 is inserted into a slit 217 formed at the operation portion 213*a*. Still further, an engagement hole 218 is opened at the position close to the operation portion 213*a* of the short circuit terminal 214. The engagement hole 218 is engaged with the retaining projection 208 when both housings 201, 202 are engaged with each other. Still further, a pair of protuberances 219 are arranged so as to interpose the engagement hole 218 therebetween. These protuberances 219 serve to short-circuit the terminals by coming in contact with both lock detecting terminals 220, which will be described later, when both housings 201, 202 are engaged with each other.

Both lock detecting terminals 220 are made of pin-like electrically conducting metal pieces that are bent so as to be substantially perpendicular at an intermediate position like the male terminals 205. One end side of each lock detecting terminal 220 is disposed within the engagement chamber 203 through an insertion hole 221 for detecting the male housing 201, while the other end side thereof is disposed at a predetermined position through the small hole 207 of the correcting plate 206. The ends of the lock detecting terminals 220 which are inserted into the engagement chamber 203 extend along the upper wall surface of the engagement chamber 203 up to positions right at the front opening edge of the engagement chamber 3 while keeping a predetermined distance from each other. In addition, the distal ends of the lock detecting terminals 220 are bent perpendicularly in such a direction as to meet each other, so that the distal ends confront each other while interposing the aforementioned retaining projection 209 therebetween. The bent portions serve as contact portions 222 that come in contact with the short circuit terminal 214.

Furthermore, protective walls 223 are formed integrally on the upper wall surface of the engagement chamber 203, the protective wall 223 serving to cover both lock detecting terminals 220, respectively. Both protective walls 223 are formed so that the front edges thereof are flush with the front edge of the engagement chamber 203, and extend almost all along the length of the upper wall surface. In addition, the section of each protective wall facing the opening side is substantially L-shaped. Specifically, both lock detecting terminals 220 are inserted into the engagement chamber 203 from the detecting terminal insertion hole 221, introduced into terminal holding grooves 224 within the protective walls 223 thereafter, and held while interposed within the terminal holding grooves 224 almost without gap. However, the portions of both protective walls 223 facing the front edge portion of the engagement chamber 203 are cut away so that the contact portions 222 of both lock detecting terminals 220 are exposed.

Next, advantageous effects of the thus constructed embodiment will be described specifically (see FIGS. 16, 17). When the female housing 202 is pushed into the male housing 201 while aligned with the male housing 201 to engage the female housing 202 with the male housing 201, the retaining projection 209 presses the upper surface of the short circuit terminal 214 down, which in turn flexes the resilient operation piece 213 downward. Upon complete engagement of both housings 201, 202, the retaining projection 209 is adapted to the engagement hole 218, so that the resilient operation piece 213 returns upward. As a result, the retaining projection 209 is engaged with the engagement hole 218, which in turn causes both housings 201, 202 to be engaged with each other so as not to come off from each other. Simultaneously therewith, since both protuberances 219 of the short circuit terminal 214 come in contact with the contact portions 222 of both lock detecting terminals 220, both lock detecting terminals 220 are short-circuited. Therefore, if both lock detecting terminals are conducting, then complete engagement of both housings 201, 202 is detected electrically through both lock detecting terminals that are conducting.

By the way, even if both housings 201, 202 are misaligned at the time of engagement, there is no likelihood that the edge portion of the female housing 202 will be caught on the contact portions 222 of the lock detecting terminals 220, since the protective walls 223 cover the detecting terminals 220 and the front edge surfaces of the protective walls 223 are designed to be substantially flush with the opening edge of the housing 201. Therefore, deformation of the lock detecting terminals 220 can be obviated, which not only allows the lock detecting terminals 20 to be held in regular position at all times, but also facilitates housing 201, 202 engaging operation and contributes to reliable lock detection.

It should be noted that the present invention may be modified in various modes. For example, the lock detecting terminals 220 may be disposed on the side wall surfaces of the housing, although the lock detecting terminals 220 are disposed on the upper wall surface of the housing in this embodiment.

THIRD EMBODIMENT

A third embodiment of the present device will now be described in detail hereinafter with reference to FIGS. 19 to 28.

Figure 19:
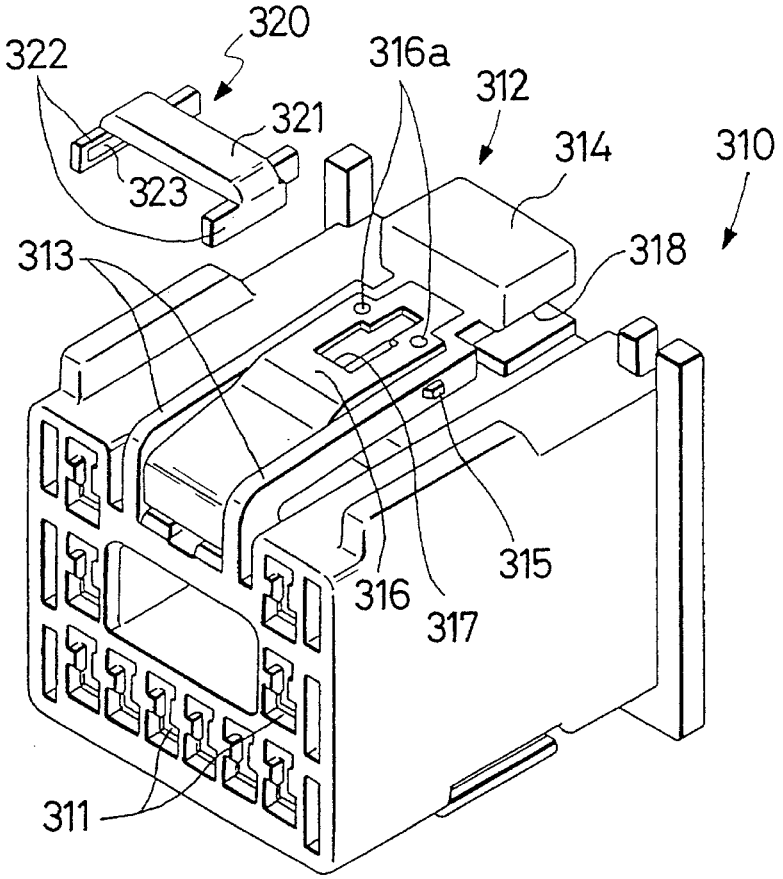
FIG. 19 is a perspective view of the appearance of a connector on the female side with a cover removed therefrom.
Figure 20:
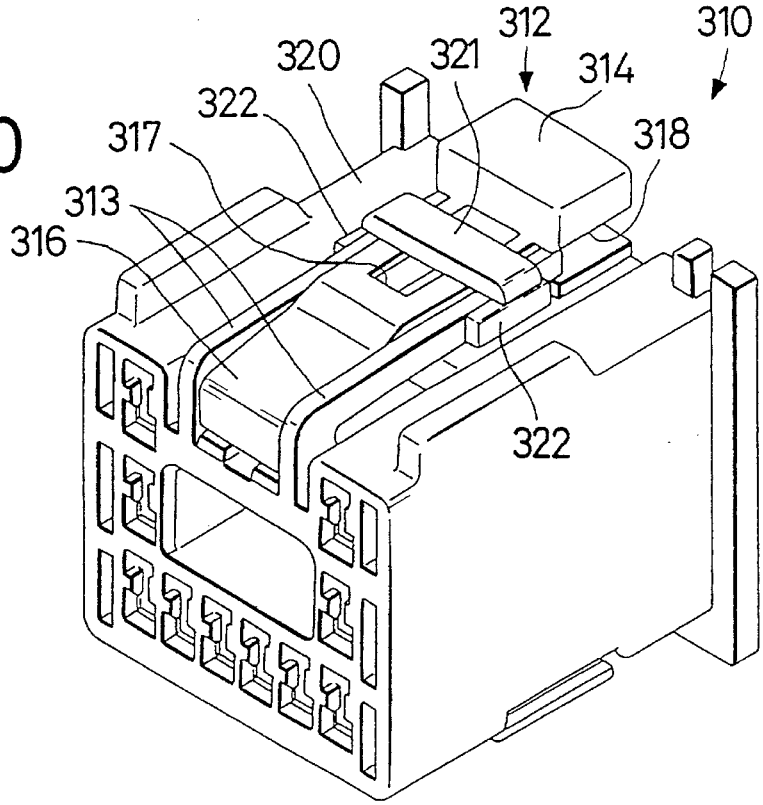
FIG. 20 is a perspective view of the appearance of the connector on the female side with the cover attached thereto.

FIG. 19 shows a connector 310 on the female side having cavities 311 into which not shown female terminal fittings are inserted. The connector 310 on the female side is made of synthetic resin. An axially extending flexible lock piece 312 is formed integrally on the upper surface of the connector 310 so as to be elastically deformable vertically. This flexible lock piece 312 is formed by coupling a pair of slenderly extending arm portions 313, 313 to a block portion 314. Guide projections 315 for guiding a cover 320 are formed on the outer surfaces of both arm portions 313, 313. The cover 320 will be described later.

In addition, a short circuit electrode 316 is interposed between both arm portions 313, 313 so as to be elastically deformable integrally with the arm portions. The short circuit electrode 316 is made of a metallic plate. An engagement hole 317 is formed at a position that is rather rearward with respect to the middle of the short circuit electrode 316 in the axial direction. On the upper surface of the short circuit electrode 316 are a pair of contacts 316*a*, 316*a*. These contacts 316*a*, 316*a* are positioned on both sides of the engagement hole 317.

Moreover, the cover 320 for protecting these contacts 316*a*, 316*a* of the short circuit electrode 316 is attached to the flexible lock piece 312. The cover 320 is composed of a protective plate portion 321 and a pair of slide portions 322, 322. The protective plate portion 321 spans the arm portions 313, 313 of the flexible lock piece 312 and the short circuit electrode 316, and the slide portions 322, 322 are formed at both ends of the protective plate portion 321 and extend in parallel with the arm portions 313, 313. The cover 320 not only allows guide grooves 323 formed on the inner surfaces of the slide portions 322 to be fitted with the guide projections 315 by causing the slide portions 322 to move along the outer surfaces of the arm portions 313, but also allows the rear ends of the slide portions 322 to be fitted with guide recessed 318 formed on the sides of the block portion 314, so that the cover 320 can move relative to the connector 310 on the female side in the axial direction. When the cover 320 is set to a protecting position that is at the front end of the movable range thereof, the protective plate portion 321 covers the contacts 316*a*, 316*a* from above, whereas when the cover 320 is set to an opening position that is at the rear end of the movable range thereof, the protective plate portion 321 exposes the contacts 316*a*, 316*a* while displaced rearward from the contacts 316*a*, 316*a*.

Figure 21:
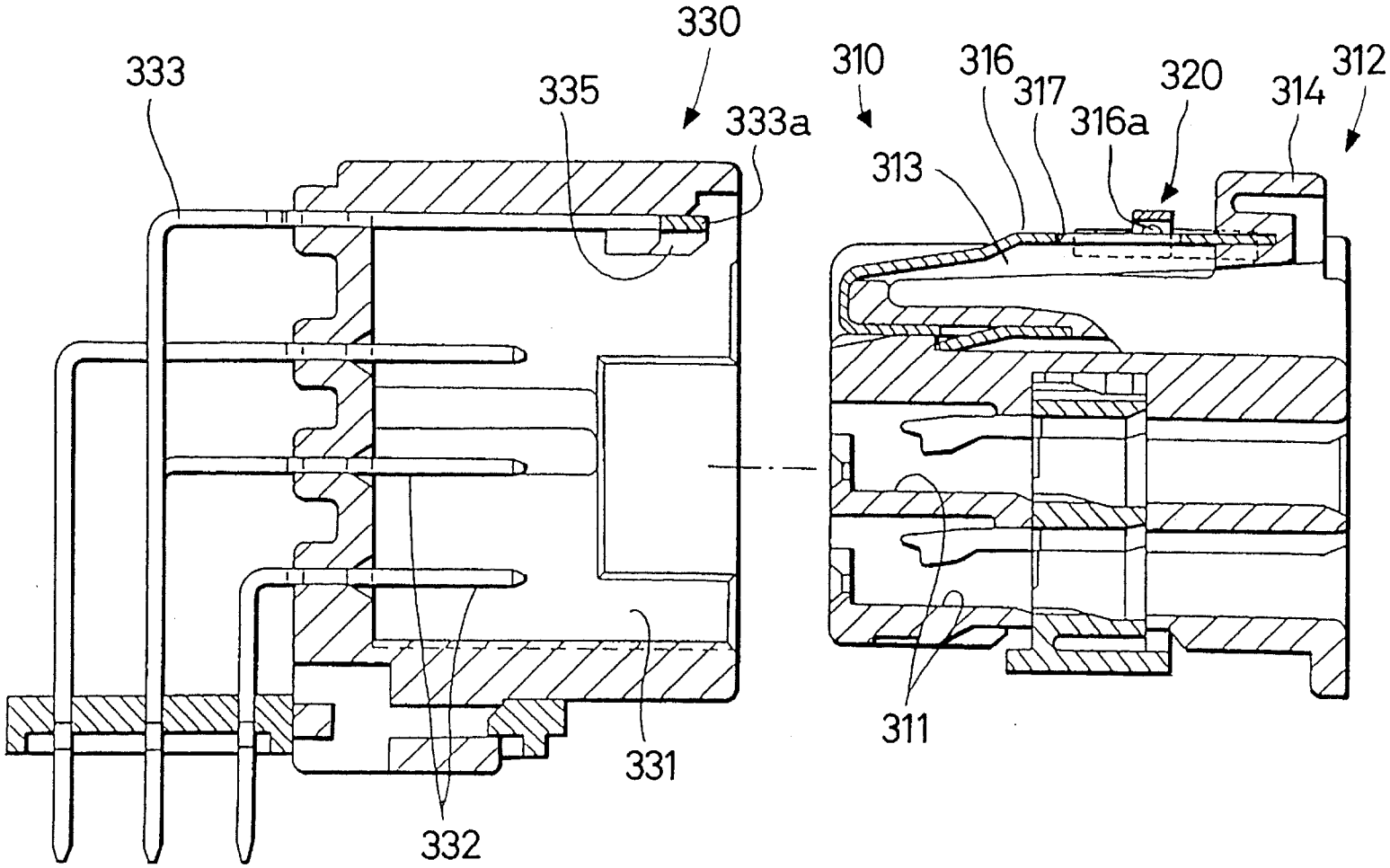
FIG. 21 is a sectional view of a connector on the male side and the connector on the female side disconnected from each other.
Figure 22:
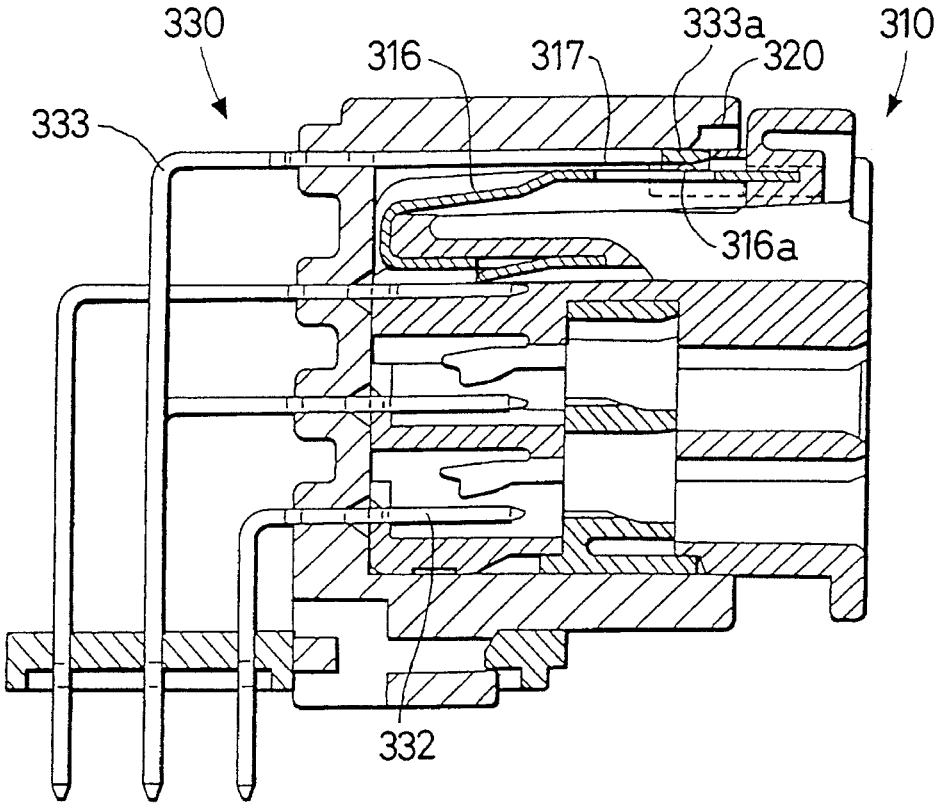
FIG. 22 is a sectional view of the connector on the male side and the connector on the female side connected to each other.
Figure 23:
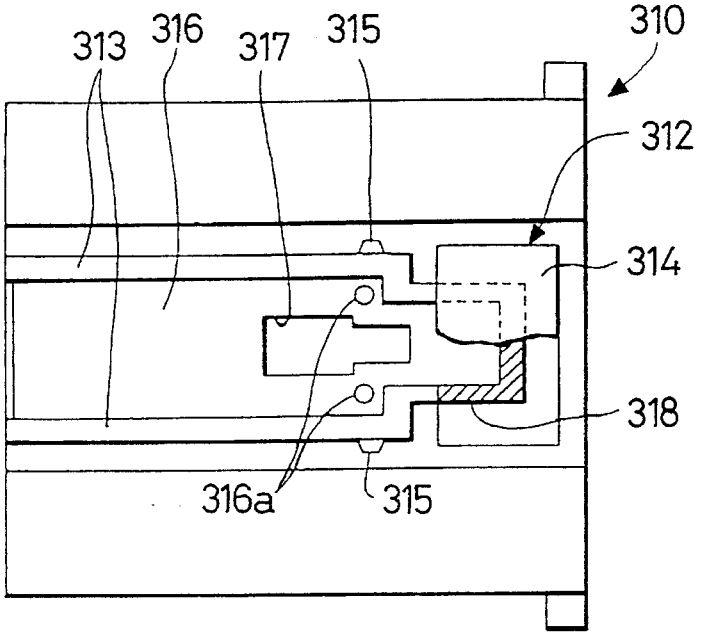
FIG. 23 is a partially cutaway plan view of the connector on the female side with the cover removed therefrom.

On the other hand, located on the left side in FIG. 21 is a connector 330 on the male side made of synthetic resin. The connector 330 on the male side has male terminal fittings 332 that project toward a hood portion 331 in the front and confront the cavities 311 of the connector 310 on the female side. A pair of L-shaped detecting electrodes 333, 333 connected to a not shown detecting circuit are attached to the connector 330 on the male side so as to extend along and project from the upper inner wall of a hood portion 331 of the connector 330. Both detecting electrodes 333, 333 are such that distal ends thereof 333*a*, 333*a* projecting toward the hood portion 331 are inwardly bent, and such inwardly bent portions 333*a*, 333*a* are coupled to each other by an insulating engagement portion 335 (equivalent to the engagement portion recited in the claim of the present device) that projects downward from the bent portions 333*a*, 333*a*. With the connector 310 on the female side being correctly inserted into the hood portion 331 of the connector 330 on the male side, not only the distal ends 333*a*, 333*a* of the detecting electrodes 333, 333 come in contact with the contacts 316*a*, 316*a* of the short circuit 316 from above, but also the engagement portion 335 is fitted into the engagement hole 317 of the short circuit electrode 316 from above.

Next, a mode of operation of this embodiment will be described.

Figure 24:
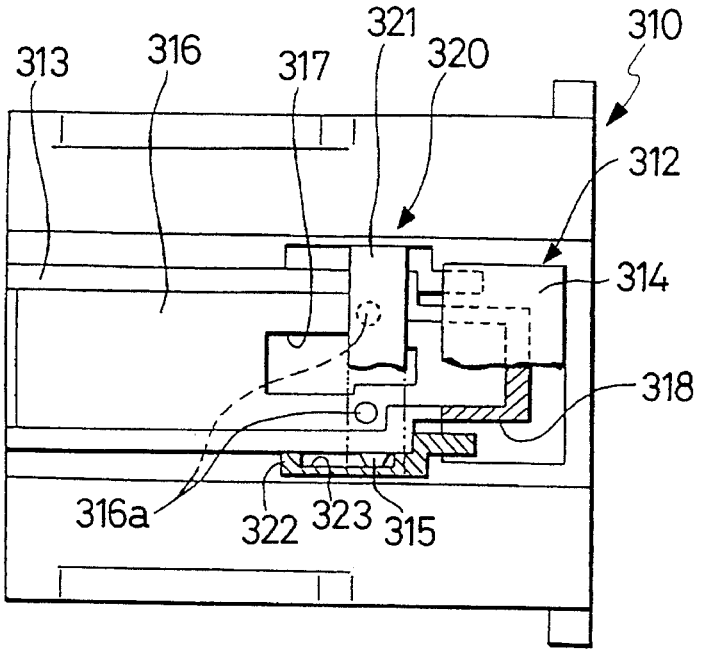
FIG. 24 is a partially cutaway plan view of the connector on the female side with the cover set to a protecting position.
Figure 25:
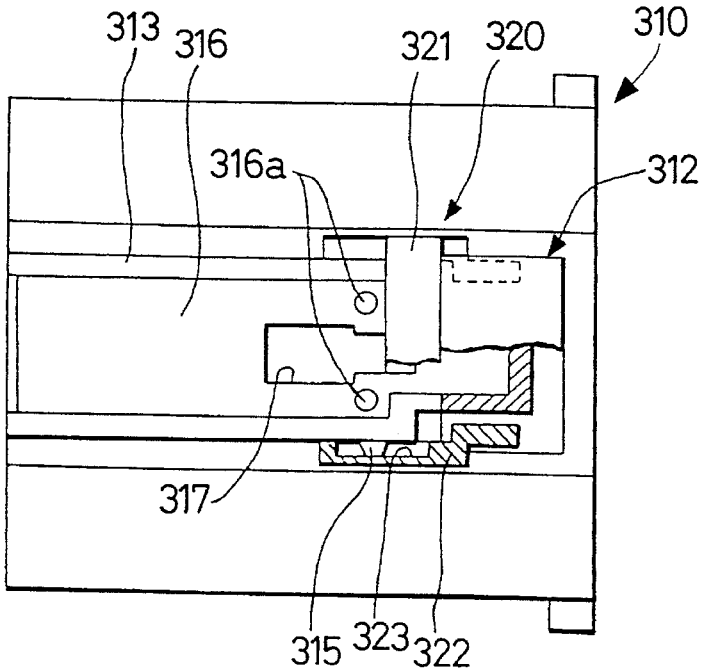
FIG. 25 is a partially cutaway plan view of the connector on the female side with the cover set to a detecting position.

With the connector 310 on the female side not connected to the connector 330 on the male side, the cover 320 of the connector 310 on the female side is set to the protecting position at which the contacts 316*a*, 316*a* of the short circuit electrode 316 are covered thereby as shown in FIG. 24. Accordingly, foreign matter such as dirt and dust is hard to deposit on the contacts 316*a*, 316*a* of the short circuit electrode 316. To visibly check if foreign matter has been deposited on the contacts 316*a*, 316*a* of the short circuit electrode 316, the cover 320 is slid rearward to the opening position to thereby expose the contacts 316*a*, 316*a* as shown in FIG. 25. As a result, the conditions of the contacts 316*a*, 316*a* can be inspected visibly. Upon completion of the visible inspection, the cover 320 is moved back frontward to the protecting position as shown in FIG. 24. Thus, the contacts 316*a*, 316*a* of the short circuit electrode 316 can be protected and inspected easily as well as reliably, which in turn facilitates quality control.

Figure 26:
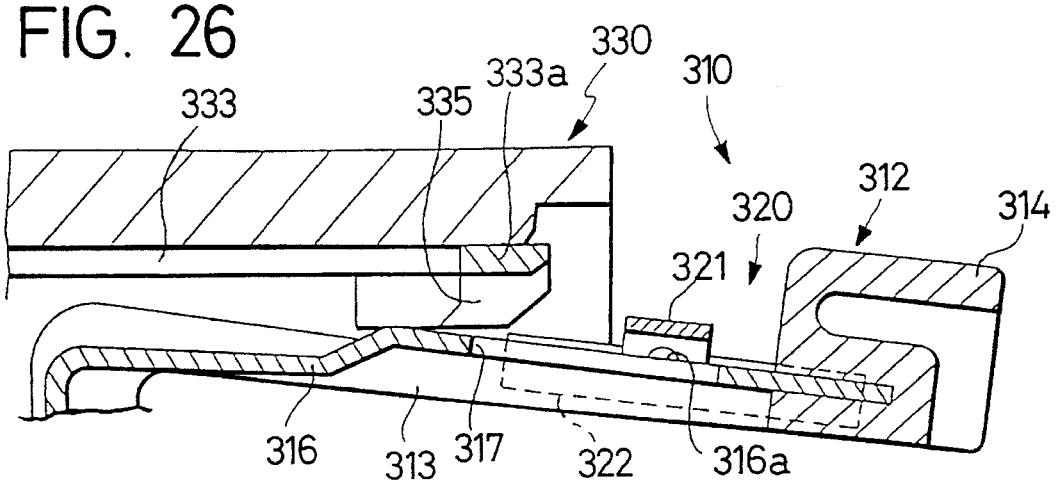
FIG. 26 is a partially enlarged sectional view of the connector on the male side and the connector on the female side when connection of both connectors is started.

In addition, to connect the connector 310 on the female side to the connector 330 on the male side, the connector 130 on the female side is inserted into the hood portion 331 of the connector 330 on the male side. As a result, as shown in FIG. 26, at the initial stage of the insertion, the engagement portion 335 at the distal ends of the detecting electrodes 333, 333 comes in contact with the upper surface of the short circuit electrode 316 to thereby elastically deform the short circuit electrode 316 together with the flexible lock piece 312 downward, so that the detecting electrodes 333, 333 are kept distant from the short circuit electrode 316.

Figure 27:
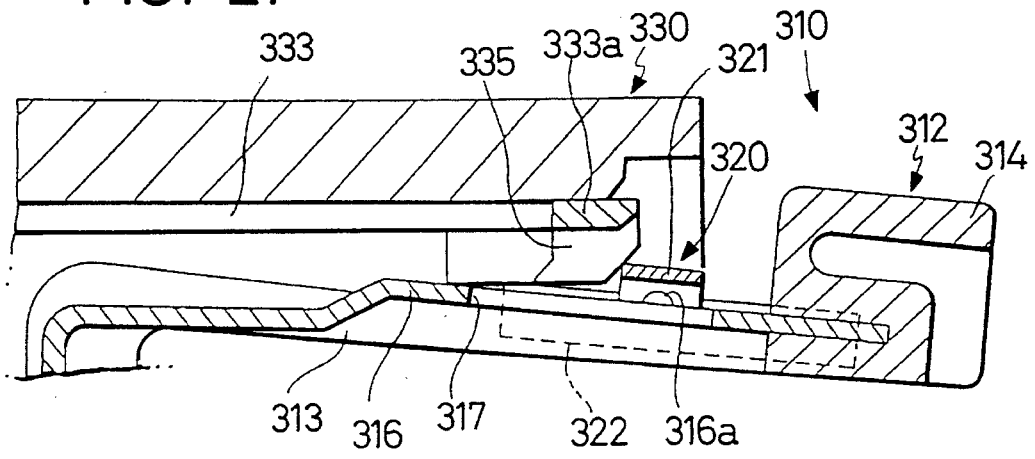
FIG. 27 is a partially enlarged sectional view of the connector on the male side and the connector on the female side when the connection of both connectors is being effected.

As the connector 310 is further inserted into the connector 330, as shown in FIG. 27, the front end of the engagement portion 335 comes in contact with the front end of the protective plate portion 321. As the connector 310 is still further inserted into the connector 330, the engagement portion 335 pushes the cover 320 so that the cover 320 moves rearward with the detecting electrodes 333, 333 not being in contact with the short circuit electrode 316.

Figure 28:
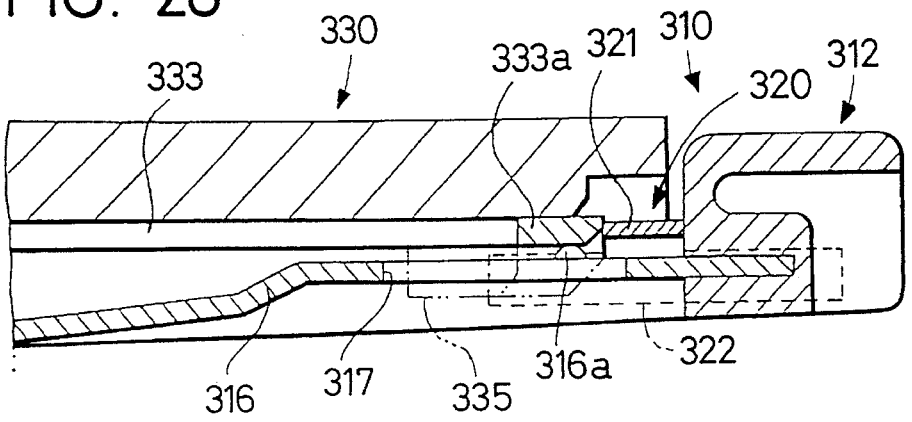
FIG. 28 is a partially enlarged sectional view of the connector on the male side and the connector on the female side when the connection of both connectors has been completed.

Upon complete connection of the both connectors 310, 330, the cover 320 pushed by the engagement portion 335 moves to the opening position, which moves the engagement portion 335 to such a position as to be engageable with the engagement hole 317 of the short circuit electrode 316 and thereby releases the pushing of the engagement portion 335 toward the flexible lock piece 312 and the short circuit electrode 316. Accordingly, the flexible lock piece 312 and the short circuit electrode 316 return upward by the restitutive force, and as shown in FIG. 28, not only the engagement portion 335 gets engaged with the engagement hole 317, but also the distal ends 333*a*, 333*a* of the detecting electrodes 333, 333 come in contact with the contacts 316*a*, 316*a* of the short circuit electrode 316.

Since the rear end of the engagement portion 335 becomes engageable with the front end of the engagement hole 317 upon engagement of the engagement portion 335 with the engagement hole 317, both connectors 310, 330 are locked so as not to be movable in such a direction as to be released from each other. When the short circuit electrode 316 comes in contact with the detecting electrodes 333, 333, both detecting electrodes 333, 333 are short-circuited, which causes the detecting circuit to detect the short-circuiting and hence the correct locking of both connectors 310, 330.

During this connecting operation, the cover 320 set to the protecting position is pushed by the engagement portion 335 to move to such a position as to expose the contacts 316*a*, 316*a* of the short circuit electrode 316. Therefore, no extra step of removing the cover 320 from the connector 310 on the female side before starting the connecting operation is required. Hence, efficiency in the entire connecting operation is improved.

In addition, unless both connectors 310, 330 are locked with the engagement portion 335 engaged with the engagement hole 317, the detecting electrodes 333, 333 never come in contact with the short circuit electrode 316. Therefore, there is no danger of mistaking a false locking of the connectors with the detecting electrodes 333,333 coming in false contact with the short circuit electrode 316 for a correct locking.

It should be noted that the present device is not limited to the aforementioned embodiment and, therefore, that various modifications may be made without departing from the spirit of the present device.

What is claimed is:

1. A lock detecting connector comprising:

at least one pair of lock detecting terminals in a first connector housing; and a short circuit terminal in a second connector housing, the short circuit terminal serving to detect a locked state of said first and second connector housings by way of short-circuiting the at least one pair of lock detecting terminals when said first and second connector housings are completely engaged with each other in an engaged position, wherein the at least one pair of lock detecting terminals is arranged along an inner wall surface of said first connector housing that accommodates the lock detecting terminals, said at least one pair of lock detecting terminals being disposed along an upper wall of the second connector housing in said engaged position, and wherein said first connector housing further includes protective walls for covering the at least one pair of lock detecting terminals, said protective walls being formed on an inner surface of the first connector housing with a portion of an inner surface of each of the at least one pair of lock detecting terminals contacting the short circuit terminal.

2. A lock detecting connector as claimed in claim 1, wherein said short circuit terminal includes a leaf spring.

3. A lock detecting connector as claimed in claim 1, wherein a flexible lock piece is formed on one of the first and second connector housings and an engagement portion is formed on the other of the first and second connector housing, respectively, and wherein said short circuit terminal is electrically connected to the at least one pair of lock detecting terminals when said flexible lock piece is engaged with said engagement portion.

4. A lock detecting connector comprising:

at least one pair of lock detecting terminals in a first one of first and second connector housings; and a short circuit terminal in a second of said first and second connector housing, the short circuit terminal serving to detect a locked state of the first and second connector housings by way of short-circuiting the at least one pair of lock detecting terminals when the first and second connector housings are completely engaged with each other, wherein the at least one pair of lock detecting terminals is arranged along an inner wall surface of the first connector housing accommodating the lock detecting terminals, and wherein said first connector housing further includes protective walls for covering the at least one pair of lock detecting terminals, said protective walls being formed on an inner surface of the first connector housing, with an inner surface of each of the at least one pair of lock detecting terminals contacting the short circuit terminal.

5. A lock detecting connector as claimed in claim 4, wherein said short circuit terminal includes a leaf spring.

6. A lock detecting connector as claimed in claim 4, wherein a flexible lock piece is formed on one of the first and second connector housings and an engagement portion is formed on the other of the first and second connector housings, respectively, and wherein said short circuit terminal is electrically connected to the at least one pair of lock detecting terminals when said flexible lock piece is engaged with said engagement portion.

7. A lock detecting connector as claimed in claim 1, wherein distal ends of the at least one pair of lock detecting terminals are positioned backward with respect to an engagement opening of the first connector housing.

* * * * *